US012599215B2

(12) United States Patent
Kablack

(10) Patent No.: US 12,599,215 B2
(45) Date of Patent: Apr. 14, 2026

(54) HAIR CLIP CONVERTIBLE COMB

(71) Applicant: CONAIR LLC, Stamford, CT (US)

(72) Inventor: Kaitlin Ann Kablack, Briarcliff Manor, NY (US)

(73) Assignee: CONAIR LLC, Stamford, CT (US)

( * ) Notice: Subject to any disclaimer, the term of this patent is extended or adjusted under 35 U.S.C. 154(b) by 153 days.

(21) Appl. No.: 18/485,742

(22) Filed: Oct. 12, 2023

(65) Prior Publication Data

US 2025/0120488 A1 Apr. 17, 2025

(51) Int. Cl.
*A45D 8/30* (2006.01)
*A45D 24/10* (2006.01)

(52) U.S. Cl.
CPC ..... *A45D 24/10* (2013.01); *A45D 8/30* (2013.01)

(58) Field of Classification Search
CPC ... A45D 8/20; A45D 8/22; A45D 8/24; A45D 8/30; A45D 24/10
USPC ..... D28/40
See application file for complete search history.

(56) References Cited

U.S. PATENT DOCUMENTS

| | | | | |
|---|---|---|---|---|
| D158,343 | S | 4/1950 | Watson | |
| 3,998,233 | A * | 12/1976 | Dorr | A45D 8/24 132/279 |
| 6,446,639 | B1 | 9/2002 | Shyu | |
| D473,015 | S | 4/2003 | Shyu | |
| D580,099 | S | 11/2008 | Pich-On | |
| D771,868 | S | 11/2016 | Hsu | |
| D776,346 | S | 1/2017 | Magnani | |
| D939,766 | S | 12/2021 | Garcia | |
| D982,235 | S | 3/2023 | Chen | |
| D1,002,104 | S | 10/2023 | Cai | |
| D1,035,142 | S | 7/2024 | Muscato | |
| D1,067,517 | S | 3/2025 | Zhou | |
| D1,095,980 | S | 9/2025 | Ryan | |
| 2008/0216861 | A1 * | 9/2008 | Shyu | A45D 8/20 132/277 |
| 2014/0209117 | A1 | 7/2014 | Wang | |
| 2023/0263283 | A1 | 8/2023 | Burgio | |
| 2024/0365944 | A1 | 11/2024 | Hsu | |

FOREIGN PATENT DOCUMENTS

CN 307850269 S 2/2023

OTHER PUBLICATIONS

International Search Report and Written Opinion dated Dec. 9, 2024 from corresponding International Patent Application No. PCT/US2024/046447, 13 pages.

Prep 2-in-1 Claw Clip Comb, Published on 2025 (online), Retrieved on Oct. 20, 2025 (online), https://www.ulta.com/p/prep-2-in-1-claw-clip-comb-pimprod2051340?, 2025.

Scunci Soft Touch Rectangle Claw Clip, Published on Apr. 24, 2023 (online), Retrieved on Oct. 20, 2025 (online), https://www.walmart.com/ip/Scunci-Soft-Touch-Open-Cut-Rectangle_claw_Clip_Blush_Beige/1254403644, 2023.

Style Chmistry Rectangle Claw Clip Comb, published on: unknown (online), retrieved on Oct. 20, 2025 (online), https://www.ulta.com/p/style-chmistry-rectangle-claw-clip-comb-pimprod2052079?, 2025.

* cited by examiner

*Primary Examiner* — Rachel R Steitz
(74) *Attorney, Agent, or Firm* — Ruggiero McAllister & McMahon LLC

(57) ABSTRACT

A clip is convertible between a clip configuration to hold hair and a comb configuration to comb through hair.

15 Claims, 8 Drawing Sheets

HAIR CLIP CONVERTIBLE COMB

BACKGROUND

1. Field of the Disclosure

The present disclosure relates to hair clips. In particular, the present disclosure is related to a hair clip that converts to a comb.

2. Description of Related Art

Generally, clips are used during hair styling to hold certain tufts of hair out of the way, or to hold a styled section of hair in place for a predetermined time during styling or post-styling of hair. However, clips only provide the function of holding hair.

Accordingly, other styling tools are needed for hair styling and other hair care.

Accordingly, it has been determined by the present disclosure that there is a continuing need for a device that overcomes, alleviates, and/or mitigates one or more of the aforementioned and other deleterious effects of prior devices.

SUMMARY

The present disclosure provides a clip that is convertible between a clip configuration to hold hair and a comb configuration to comb through hair.

The above-described and other features and advantages of the present disclosure will be appreciated and understood by those skilled in the art from the following detailed description, drawings, and appended claims.

DETAILED DESCRIPTION

Figure 2:
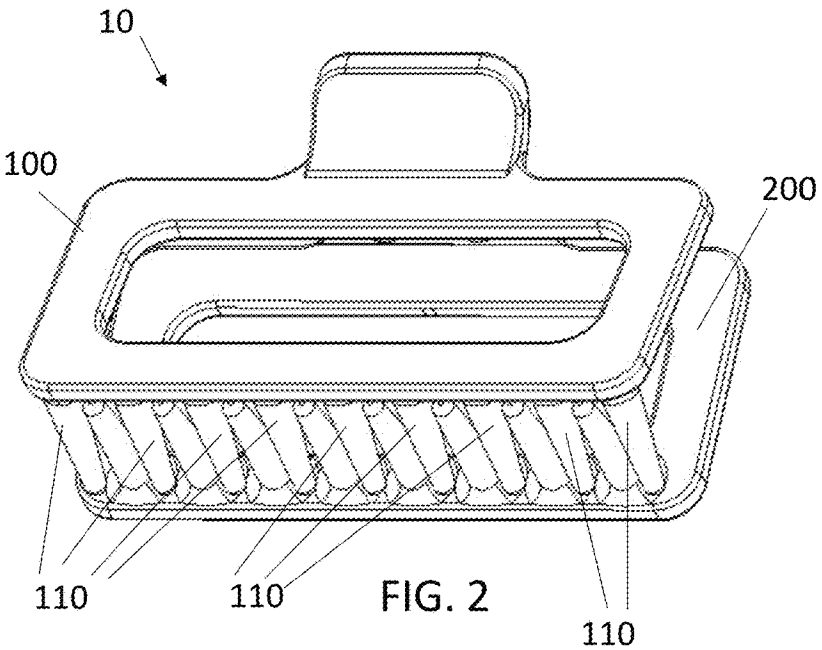
FIG. 2 is a front perspective view of the clip of FIG. 1.
Figure 1:
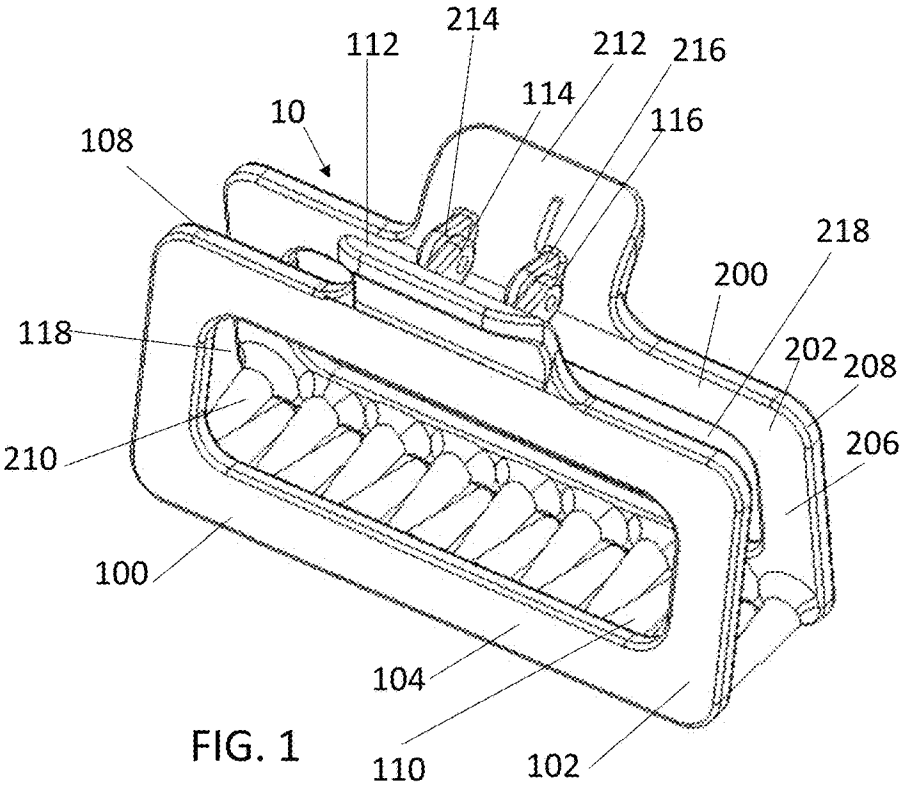
FIG. 1 is a top perspective view of a clip according to the present disclosure in a closed position of a clip configuration with parts removed for clarity.
Figure 13:
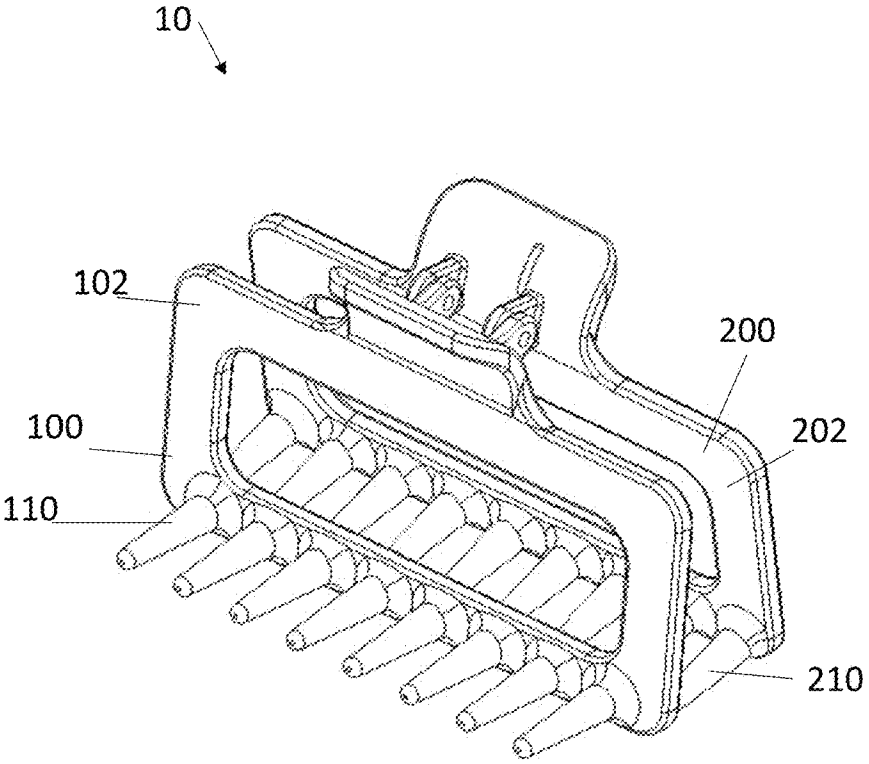
FIG. 13 is a top perspective view of the clip of FIG. 1 in the closed position and in a comb configuration.
Figure 16:
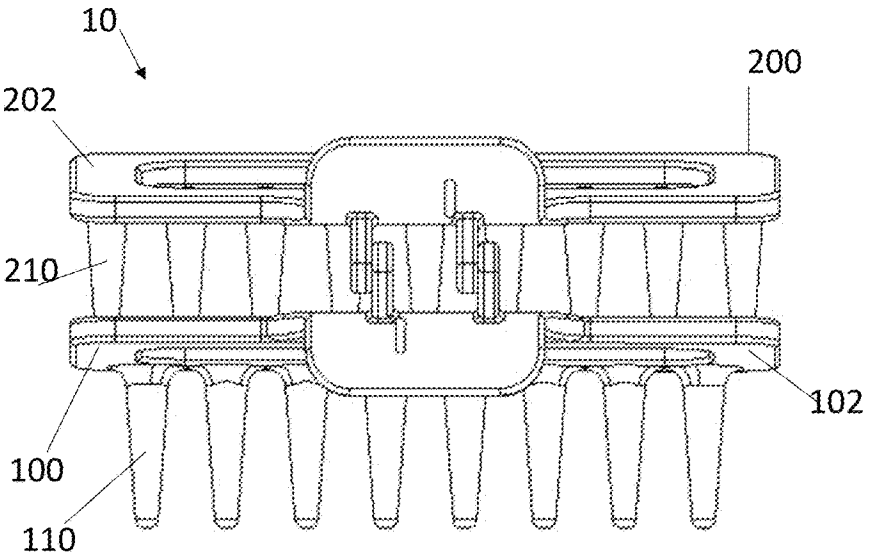
FIG. 16 is a rear view of the clip of FIG. 13.
Figure 15:
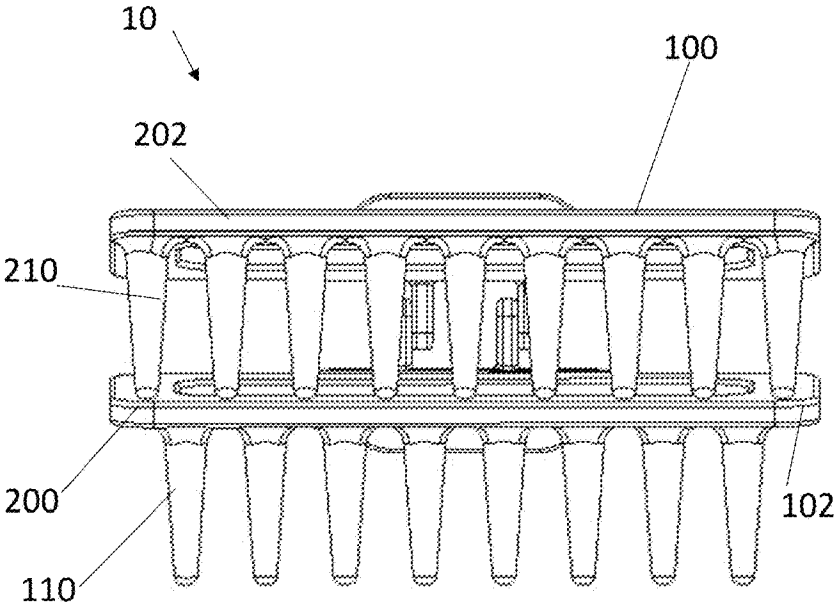
FIG. 15 is a front view of the clip of FIG. 13.

Referring to the drawings and in particular to FIG. 1, an exemplary embodiment of a clip according to the present disclosure is shown and is generally referred to by reference numeral 10. Advantageously, clip 10 is a "jaw clip" style hair clip that is convertible between a clip configuration, as shown in FIG. 1, to hold hair and a comb configuration, as shown in FIG. 13, where one of the jaws can be swiveled 180 degrees so that the teeth face outwardly and, then, the accessory can be held in the hand and used as a comb.

Referring to FIGS. 1-5, clip 10 has a first jaw 100 and a second jaw 200. First jaw 100 has a first body 102 having a first outer surface 104 opposite a first inner surface 106 (FIG. 6) forming a first edge 108 therebetween. First teeth 110 extend from first inner surface 106 on a first side of first body 102. A first tab 112 is connected to first outer edge 108 on a second side of first body 102 opposite the first side. First body 102 and first tab 112 are preferably formed of separate pieces. First tab 112 curves in a direction away from first teeth 110. Two first loops 114, 116 extend from an inner surface of first tab 112. First jaw 100 has a first aperture 118 through first body 102.

Second jaw 200 has a second body 202 having a second outer surface 204 (FIG. 3) opposite a second inner surface 206 forming a second edge 208 therebetween. Second teeth 210 extend from second inner surface 206 on a first side of second body 202. A second tab 212 extends from second outer edge 208 on a second side of second body 202 opposite the first side. Second tab 212 and second body 202 are preferably a one-piece structure. Second tab 212 curves in a direction away from second teeth 210. Second jaw 200 has two second loops 214, 216 extending from inner surface 206 of second tab 212. Second jaw 200 has a second opening 218 through second body 202.

Figure 3:
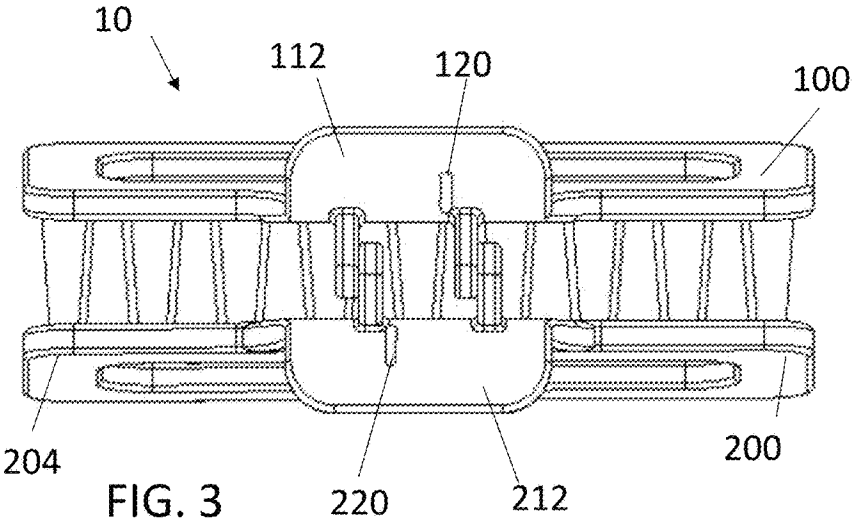
FIG. 3 is a rear view of the clip of FIG. 1.
Figure 6:
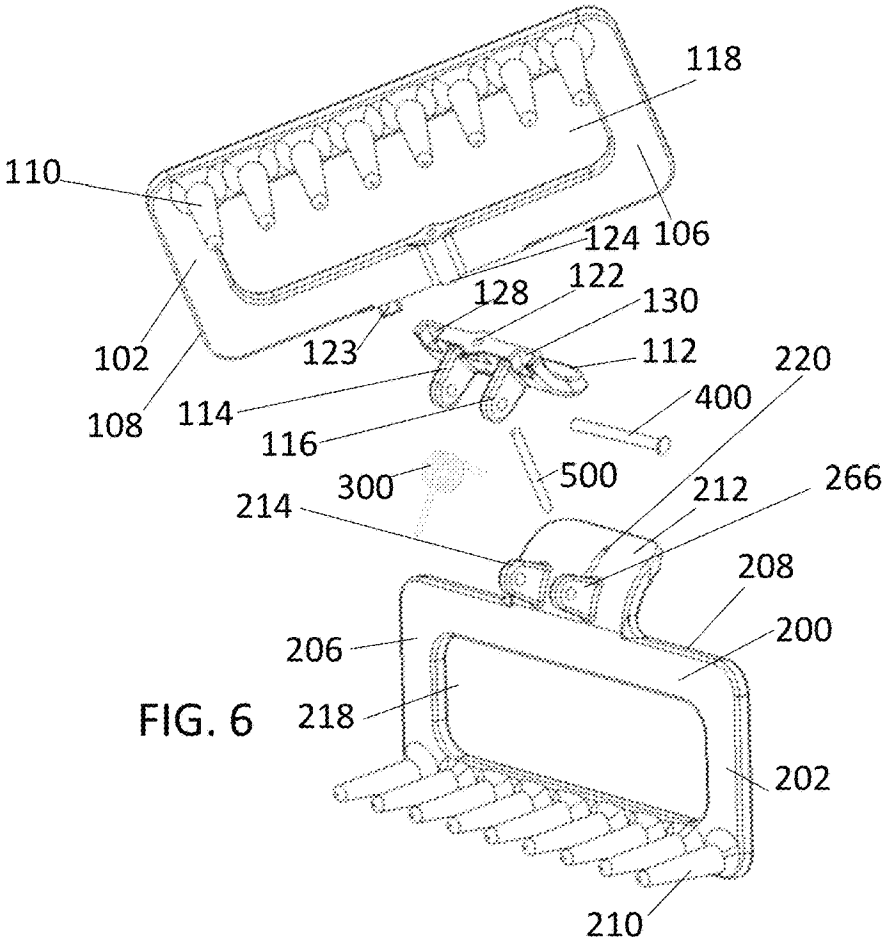
FIG. 6 is an exploded perspective view of the clip of FIG. 1.
Figure 5:
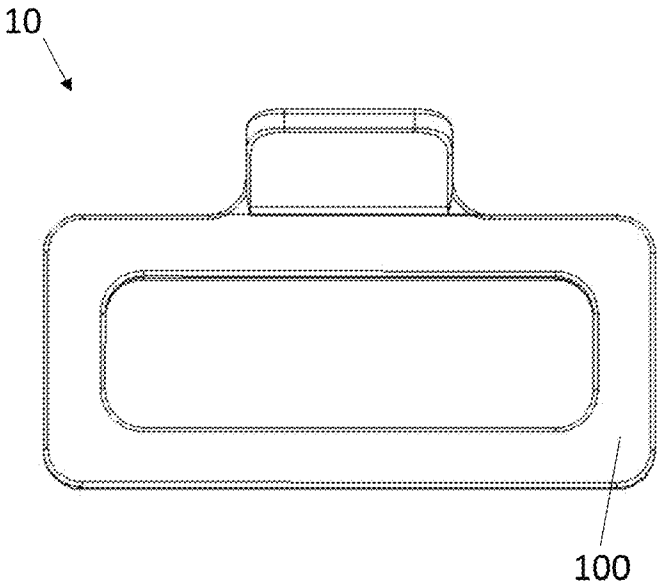
FIG. 5 is a top view of the clip of FIG. 1.
Figure 8:
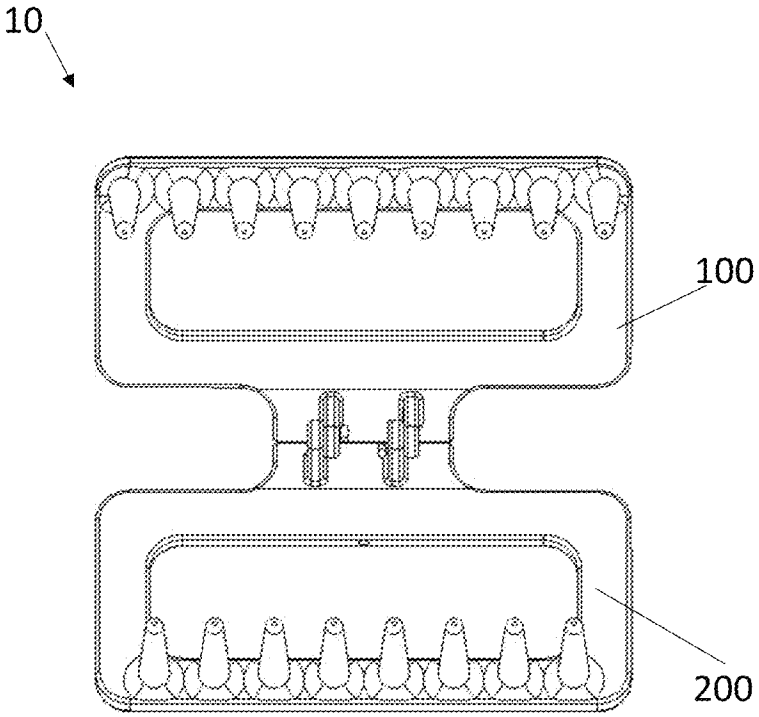
FIG. 8 is a front view of the clip of FIG. 7.

First tab 112 of first jaw 100 is rotatably connected to second tab 212 of second jaw 200 so that first jaw 100 and second jaw 200 are biased together positioning each of first teeth 110 adjacent second teeth 210 in a clip configuration as shown in FIG. 1. Loop 114 is adjacent loop 214 and loop 116 is adjacent loop 216 and a spring 300 is in between loop 114 and loop 216 so that, as shown in FIG. 6, a rod 400 can pass through each of loop 114, loop 214, loop 116, loop 216 and spring 300 to rotatably connected first jaw 100 and second jaw 200. As shown in FIG. 3, first tab 112 has a first depression 120 to receive a first portion of spring 300 and second tab 212 has a second depression 220 to receive a second portion of spring 300 to maintain spring 300 in a desirable position relative to first jaw 100 and second jaw 200.

Referring to FIG. 6, first tab 112 has an opening 122 and first body 102 has an opening 124. Opening 124 extends through first body 102 from aperture 118 through first edge 108. Pin 500 is positioned in opening 122 of first tab 112 and opening 124 of first body 102 to allow first body 102 to rotate around pin 500 relative to first tab 112 so that pin 500 forms a swivel hinge. First body 102 has a protrusion 123 extending from first edge 108 adjacent to opening 124. First tab 112 has depressions 128, 130 on opposite sides of opening 122 that are each sized to receive protrusion 123 of first body 102. In the clip configuration, protrusion 123 is in depression 128.

Figure 4:
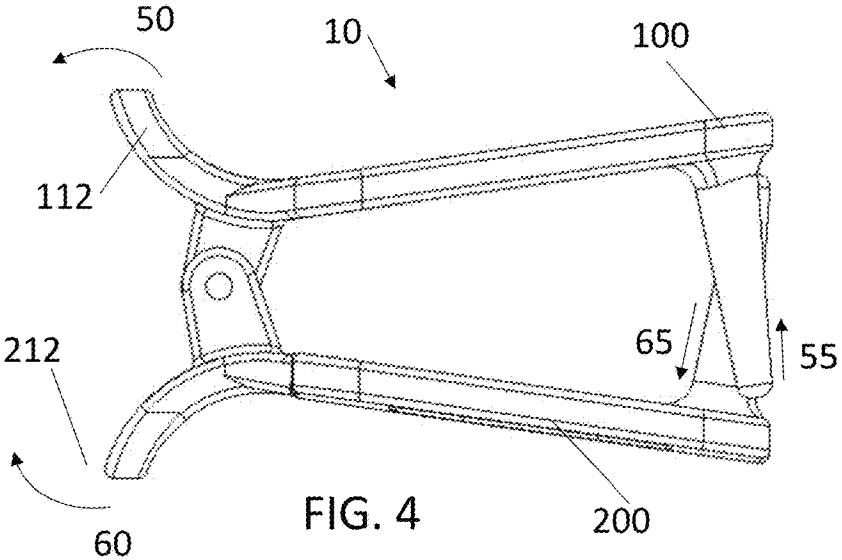
FIG. 4 is a side view of the clip of FIG. 1.
Figure 7:
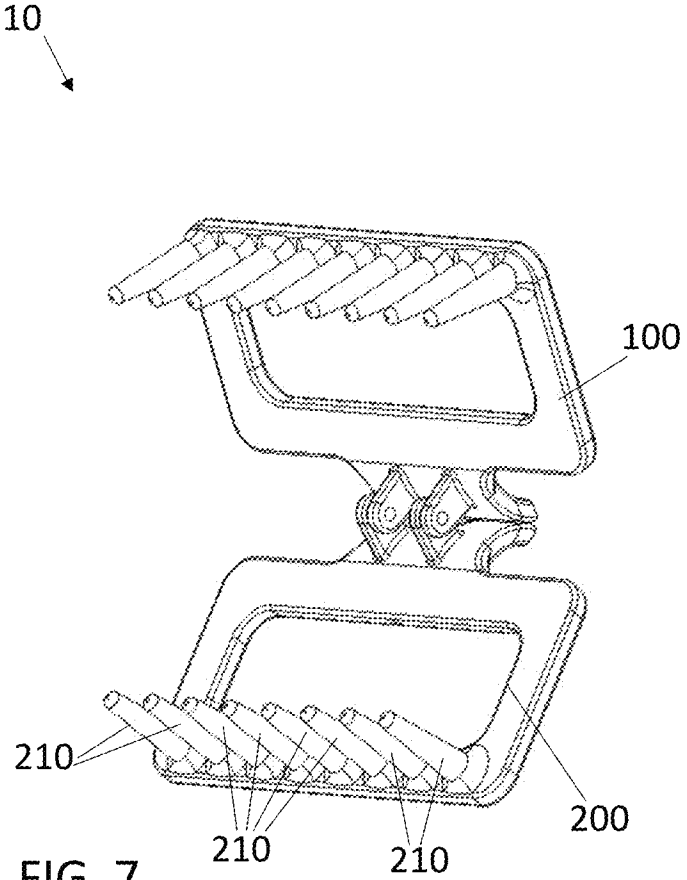
FIG. 7 is a front perspective view of the clip of FIG. 1 in an opened position.
Figure 10:
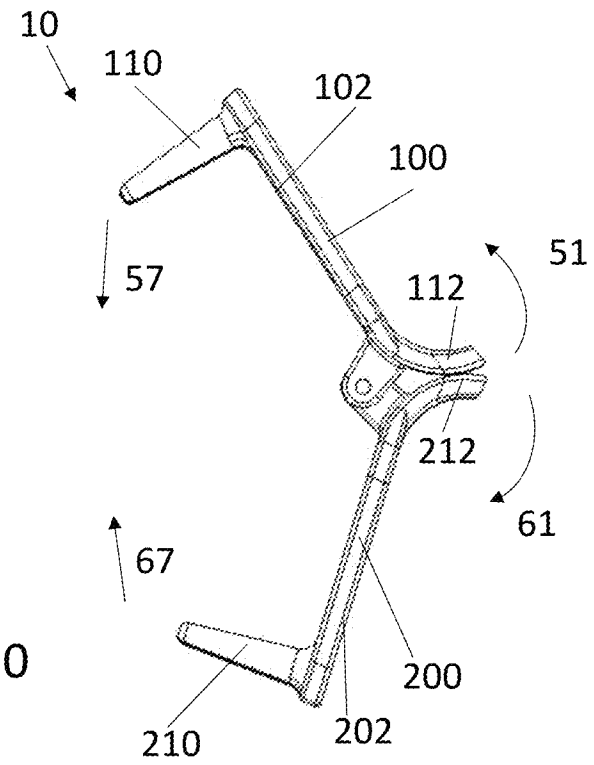
FIG. 10 is a side view of the clip of FIG. 7.

In use, if a user wants to use clip 10 in the clip configuration, as shown in FIG. 1, to hold hair, a person applies a force to squeeze first tab 112 of first jaw 100 and second tab 212 of second jaw 200 together, as shown by arrows 50 and 60 in FIG. 4, to overcome the bias of spring 300 and move first teeth 110 away from second teeth 210, as shown by arrows 55 and 65 in FIG. 4, to an opened position, as shown in FIG. 7. Hair can be inserted between first jaw 100 and second jaw 200 when clip 10 is in the opened position so that when the person releases the forces on first tab 112 of first jaw 100 and second tab 212 of second jaw 200, first tab 112 moves away from second tab 212 as shown by arrows 51 and 61 in FIG. 10, then first jaw 100 with first teeth 110 and the second jaw 200 with second teeth 210 move as shown by arrows 57 and 67 of FIG. 10 to again be biased together to hold the person's hair between first jaw 100 and the second jaw 200.

Figure 12:
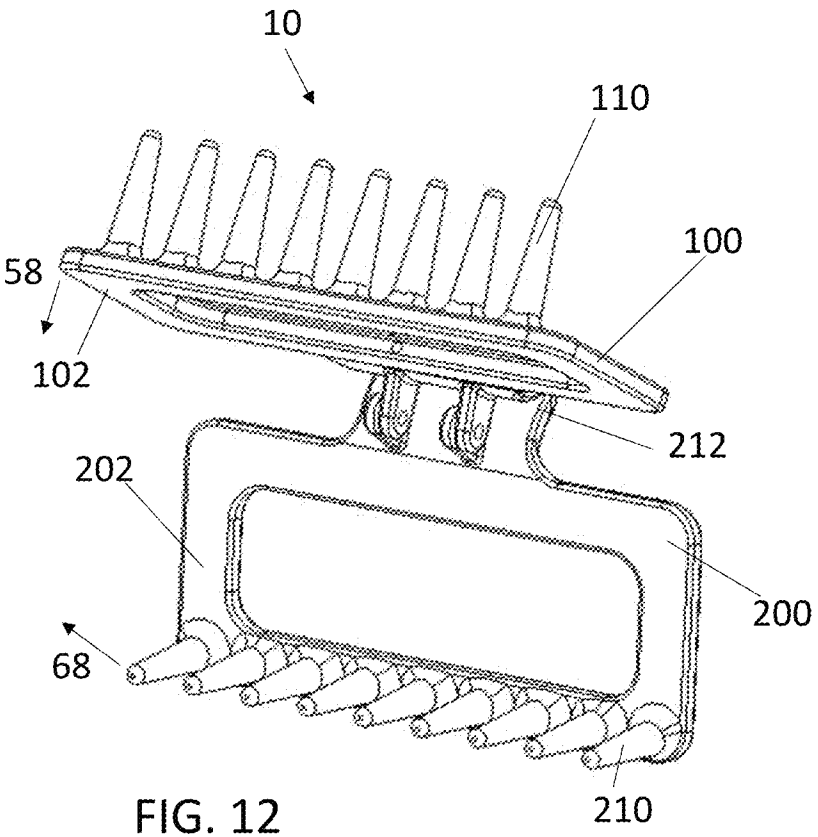
FIG. 12 is a top perspective view of the clip of FIG. 1 in the opened position and the jaw inverted from FIG. 7.
Figure 11:
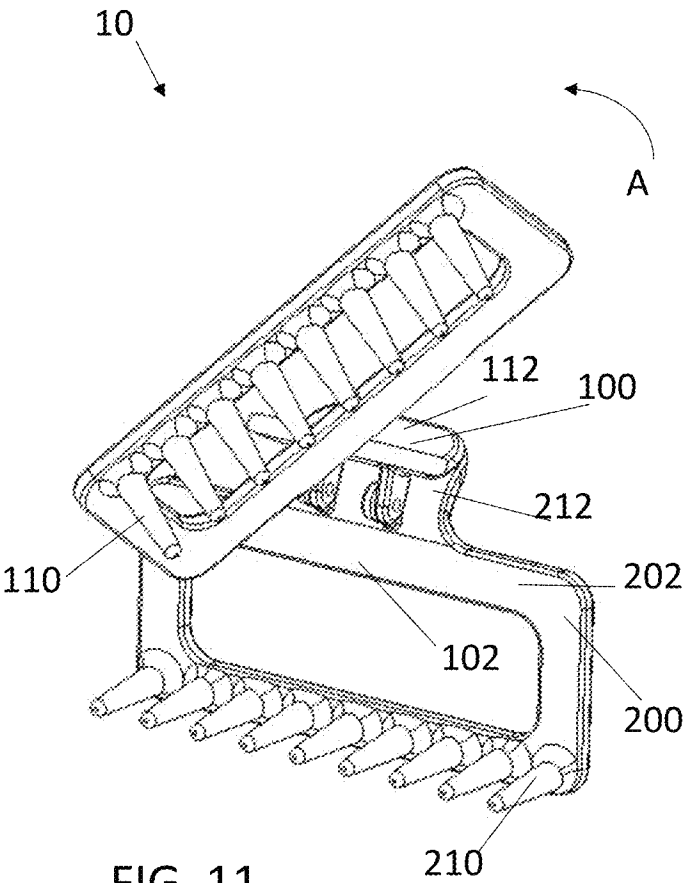
FIG. 11 is a top perspective view of the clip of FIG. 1 in the opened position and having a first jaw rotated from the clip configuration to an intermediate position.

In addition, if a user wants to use clip 10 as a comb and clip 10 is in the clip configuration shown in FIG. 1, a person applies a force to squeeze first tab 112 of first jaw 100 and second tab 212 of second jaw 200 together, as shown by arrows 50 and 60 in FIG. 4, to overcome the bias of spring 300 and move first teeth 110 away from second teeth 210, as shown by arrows 55 and 65 in FIG. 4, to the opened position, as shown in FIG. 7. Then, as shown in FIG. 11, the user rotates first body 102 on pin 500 relative to first tab 112 in a first direction A moving protrusion 123 out of depression 128 to invert first body 102 to an open inverted position as shown in FIG. 12 positioning protrusion 123 in depression 130 to prevent further rotation of first body 102 in first direction A. The user then releases the forces on first tab 112 of first jaw 100 and second tab 212 of second jaw 200 allowing spring 300 to bias first jaw 100 and second jaw 200 together, as shown by arrows 58 and 68 in FIG. 12, moving clip 200 into a comb configuration as shown in FIGS. 13-16. The user can then use first teeth 110 extending outward from first body 102 to comb through the user's hair.

Figure 9:
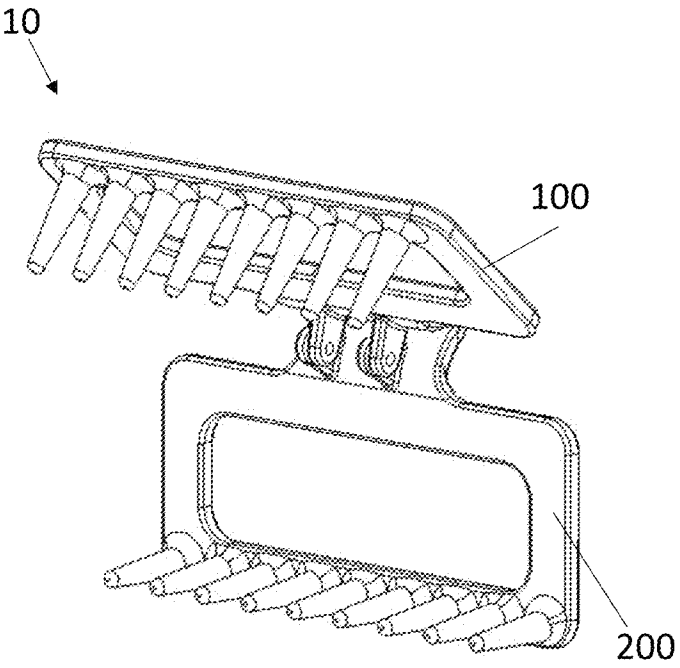
FIG. 9 is a top perspective view of the clip of FIG. 7.
Figure 14:
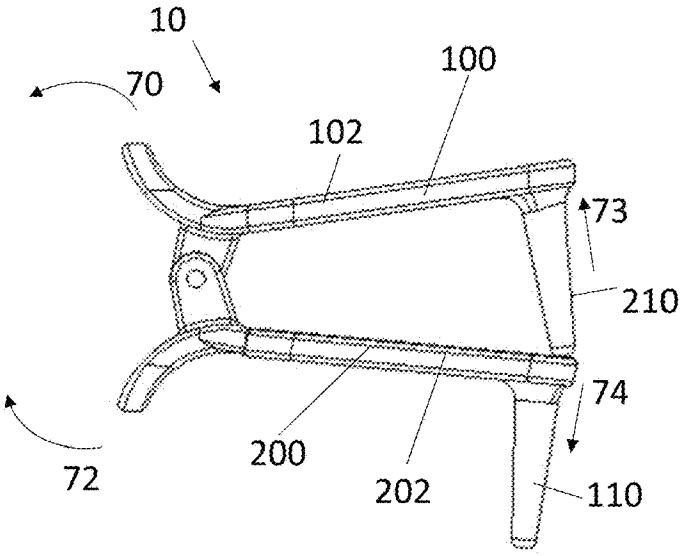
FIG. 14 is a side view of the clip of FIG. 13.

If a user again wants to use clip 10 in the clip configuration shown in FIG. 1 and the clip 10 is currently in the comb configuration as shown in FIG. 13, then the user applies a force to squeeze first tab 112 of first jaw 100 and second tab 212 of second jaw 200 together, as shown by arrows 70 and 72 in FIG. 14, to overcome the bias of spring 300 and move first jaw 100 away from second jaw 200, as shown by arrows 73 and 74 in FIG. 14, to the open inverted position as shown in FIG. 12. Then, as shown in FIG. 11, the user rotates first body 102 on pin 500 relative to first tab 112 in a second direction opposite direction A moving protrusion 123 out of depression 130 to invert first body 102 to the open position as shown in FIG. 9 positioning protrusion 123 in depression 128 to prevent further rotation of first body 102 in the second direction opposite direction A to the clip configuration as shown in FIG. 9. The user then releases the forces on first tab 112 of first jaw 100 and second tab 212 of second jaw 200 so that first tab 112 moves away from second tab 212 as shown by arrows 51 and 61 in FIG. 10, then first jaw 100 with first teeth 110 and the second jaw 200 with second teeth 210 move as shown by arrows 57 and 67 of FIG. 10 to again be biased together as shown in FIG. 1.

Accordingly, clip 10 is a "jaw clip" style hair clip that is convertible between a clip configuration, as shown in FIG. 1, to hold hair and a comb configuration where first jaw 100 can be swiveled 180 degrees so that first teeth 110 face outwardly, as shown in FIG. 13, and, then, clip 10 can be held in a user's hand and used as a comb.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents can be substituted for elements thereof without departing from the scope of the present disclosure. In addition, many modifications can be made to adapt a particular situation or material to the teachings of the disclosure without departing from the scope thereof. Therefore, it is intended that the present disclosure should not be limited to the particular embodiment(s) disclosed as the best mode contemplated, but that the disclosure will include all embodiments falling within the scope of the appended claims.

What is claimed is:

1. A clip comprising:

a first jaw having first teeth and a first body, the first body having a first outer surface opposite a first inner surface having a first edge therebetween with the first teeth extending from the first inner surface on a first side of the first body, and the first jaw having a first tab that is a separate piece connected to the first outer edge on a second side of the first body opposite the first side; and a second jaw having second teeth and a second body, the second body having a second outer surface opposite a second inner surface having a second edge therebetween with the second teeth extending from the second inner surface on a first side of the second body, the second jaw having a second tab extending from the second outer edge on a second side of the second body opposite the first side, the second jaw being connected to the first jaw, wherein the first tab of the first jaw is rotatably connected to the second tab of the second jaw so that first jaw and second jaw are biased together positioning the first teeth adjacent the second teeth in a clip configuration, wherein the clip is convertible between the clip configuration and a comb configuration, wherein the first teeth and the second teeth face each other in the clip configuration, and wherein the first jaw being swiveled 180 degrees into the comb configuration so that the first teeth face outwardly to be used as a comb.

2. The clip of claim 1, wherein the first body is rotatable relative to the first tab.

3. The clip of claim 2, further comprising a pin that is positioned in an opening of the first tab and an opening in the first body allowing the first body to be rotatable about the pin relative to the first tab so that the pin forms a swivel hinge.

4. The clip of claim 3, wherein the first body has a protrusion extending from the first edge adjacent to the opening in the first body and the first tab has a first depression and a second depression on opposite sides of the opening in the first tab that are each sized to receive the protrusion.

5. The clip of claim 4, wherein, in the clip configuration, the protrusion is in the first depression.

6. The clip of claim 5, wherein, in the clip configuration, a force can be applied to the first tab of the first jaw and the second tab of the second jaw to overcome the bias to move the first teeth away from the second teeth to an opened position allowing hair to be inserted between the first jaw and the second jaw so that when the force is released the first jaw with the first teeth and the second jaw with the second teeth are again biased together to hold the hair between the first jaw and the second jaw.

7. The clip of claim 6, wherein, in the opened position, the first body is rotatable on the pin relative to the first tab in a first direction to invert the first body so that the force on the first tab of the first jaw and the second tab of the second jaw can be released to allow the first jaw and the second jaw to be biased together moving the clip into the comb configuration where the user can then use the first teeth extending outward from the first body to comb through hair.

8. The clip of claim 7, wherein, when the first body is rotating on the pin relative to the first tab in the first direction to invert the first body to the comb configuration, the protrusion is moved out of the first depression and into the second depression to prevent further rotation of the first body in the first direction.

9. The clip of claim 8, wherein the first body is rotatable on the pin relative to the first tab in a second direction opposite the first direction to move the clip from the comb configuration to the clip configuration.

10. The clip of claim 9, wherein when the first body is rotating on the pin relative to the first tab in the second direction to invert the first body, the protrusion is moved out of the second depression and into the first depression to prevent further rotation of the first body in the second direction.

11. The clip of claim 1, wherein the first tab of the first jaw is rotatably connected to the second tab of the second jaw so that first jaw and second jaw are biased together by a spring.

12. The clip of claim 11, wherein the first tab of the first jaw has loops and the second tab of the second jaw has loops so that a rod extends through the loops of the first jaw, the spring and the loops of the second jaw to connect the first jaw and the second jaw.

13. The clip of claim 11, wherein the first tab of the first jaw has a first depression to receive a first portion of the spring and the second tab of the second jaw has a second depression to receive a second portion of the spring.

14. The clip of claim 1, wherein the first jaw has a first hole through the first body.

15. The clip of claim 1, wherein the second jaw has a second hole through the second body.

* * * * *